United States Patent [19]

Roberts et al.

[11] 4,161,827

[45] Jul. 24, 1979

[54] ARTICLES OF FOOTWEAR

[75] Inventors: Patrick J. Roberts; Kevin P. Hogan; Thomas Kealy, all of Kilkenny, Ireland

[73] Assignee: Padmore & Barnes International Limited, Kilkenny, Ireland

[21] Appl. No.: 845,115

[22] Filed: Oct. 25, 1977

[30] Foreign Application Priority Data

Oct. 27, 1976 [IE] Ireland ..... 2381/76

[51] Int. Cl.[2] ..... A43B 3/14

[52] U.S. Cl. ..... 36/11

[58] Field of Search ..... 36/11, 9 R, 9 A, 32 R

[56] References Cited

U.S. PATENT DOCUMENTS

| | | | |
|---|---|---|---|
| 3,135,060 | 6/1964 | McConnell | 36/11 |
| 3,345,762 | 10/1967 | Fisher et al. | 36/9 R |
| 3,938,265 | 2/1976 | Probstl et al. | 36/11 |

FOREIGN PATENT DOCUMENTS

| | | | |
|---|---|---|---|
| 2509118 | 9/1976 | Fed. Rep. of Germany | 36/11 |

*Primary Examiner*—Parick D. Lawson

*Attorney, Agent, or Firm*—Young & Thompson

[57] ABSTRACT

A new form of commercially produced moccasin-type shoe comprises an outer wedge sole of crepe rubber, an under vamp of soft leather extending under the whole area of the foot and turned up to form a continuous unseamed rim all around the shoe, and an upper vamp, quarters and a counter hand-stitched to the rim to form an upper. The hand stitching is a form of blanket stitching designed to hold the overlapping top edge of the rim tightly against the other pieces of the upper. The stitching comprises a continuous row of stitches parallel to the top edge of the rim and a series of loop stitches perpendicular to the top edge of the rim.

6 Claims, 10 Drawing Figures

15A
16A
15B
4
17
3
14B
14A 3
4
5
9
8
5
6
2
1

3
4
12
5
9
8
5
10
6
5
2
11
1

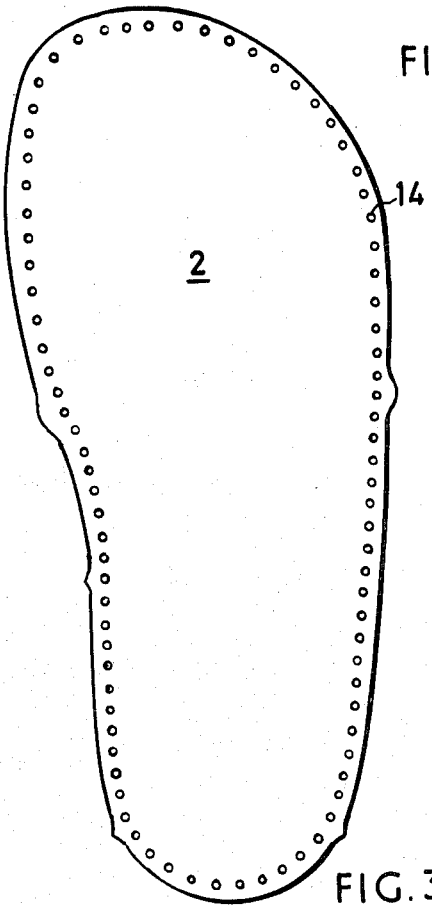
FIG.3.
FIG.3A.
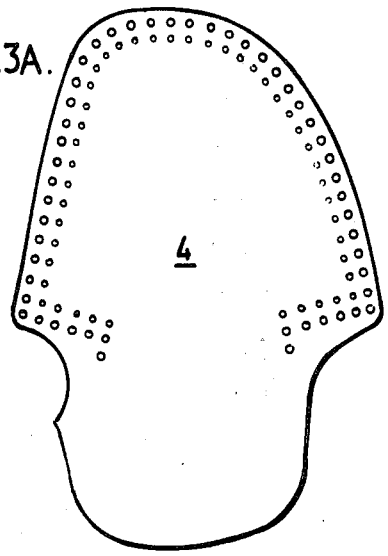
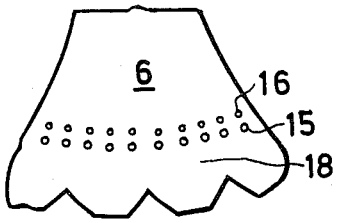
FIG.4.
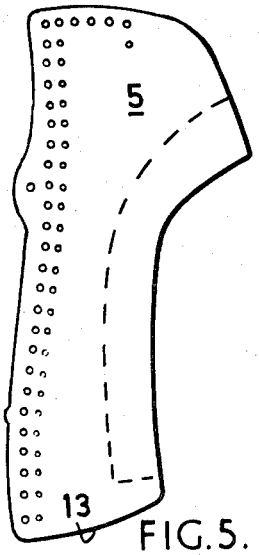
FIG.5.
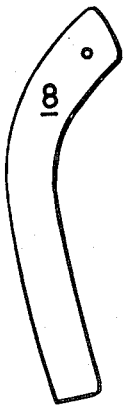
FIG.7.
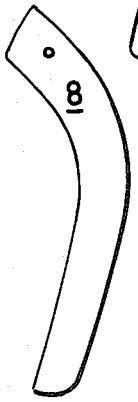
FIG.8
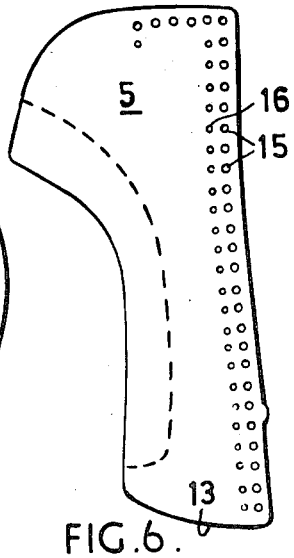
FIG.6.

ARTICLES OF FOOTWEAR

BACKGROUND OF THE INVENTION

1. Field of the Invention

The present invention relates to articles of footwear, more particularly shoes and boots of the "casual" type.

2. The Prior Art

There has been increasing demand in recent years for casual footwear of "moccasin" construction, that is, having a leather upper with part of the leather extending under the foot so that the upper is wrapped around the foot like a glove. In commercially-produced footwear, the upper has generally been secured to a sole. However, it has not been general practice to produce a shoe in which the leather of the upper extended under the foot for the whole of its length. Instead, in the region of the heel and instep the upper has been turned in only marginally and the gap has been filled by an insole which has generally been made of fibre board or other relatively stiff and inflexible material.

It has been necessary to make the insole of stiff and inflexible material because an insole of soft flexible material would tend to ruck when the upper is being closed on a last.

Proposals have been made for manufacturing moccasin-type shoes with a soft leather sole extending under the whole of the foot and a hard outer sole attached thereto in order to make the shoe suitable for outdoor wear. Such proposals are exemplified in British Pat. Nos. 1,134,369 and 1,240,452. However in these proposals the counter at the heel of the shoe has been formed by seaming the rear edges of side portions of the sole.

SUMMARY OF THE INVENTION

The present invention is based upon the discovery that a shoe of unusual comfort can be obtained by using a soft leather under vamp extending under the whole foot in conjunction with an outer sole of resilient material such as crepe rubber.

The invention provides an article of footwear having an outer sole of resilient material, an under-vamp of soft leather extending over the whole area of the outer sole, the edge of the under-vamp being turned up to form a continuous unseamed rim around the article of footwear, and pieces of soft leather hand-stitched to the rim to form an upper. Preferably the pieces of the upper overlap the inside top edge of the rim and the overlapping portions are sewn together by a form of stitching which combines a continuous row of stitches parallel to the top edge of the rim and a series of loop stitches perpendicular to said top edge and looping over said top edge.

The outer sole of resilient material is preferably crepe rubber but may also be a synthetic sole material such as polyvinylchloride, nitrile rubber, polyurethane or other synthetic resins, particularly in microcellular form.

DESCRIPTION OF THE DRAWINGS

The invention is illustrated with reference to the accompanying drawings in which:

FIGS. 3–8 show suitable pieces for making the upper of a shoe according to the invention.

FIG. 3 shows the under vamp.

FIG. 3A shows the upper vamp.

FIG. 4 shows the counter.

FIGS. 5 & 6 show the quarters.

FIGS. 7 & 8 show the topline reinforcement strips.

As shown in FIGS. 1 and 2 of the drawings, the shoe has a wedge-shaped sole 1 of crepe rubber to which is secured an under-vamp 2 of leather. The under-vamp 2 covers the whole area of the sole and its edge is turned up to form an unseamed rim 3 all around the shoe. The upper vamp 4, the quarters 5 and the counter 6 are all stitched to the rim 3. In the embodiment shown in the drawings, the rim overlaps outside the edges of the other leather pieces, and the overlasting portions are sewn together as a form of "blanket stitch" which combines a lower continuous row of horizontal stitches with a series of upward loops which bind the top of the rim against the other leather pieces. The quarters have topline strips 8 secured thereto to prevent stretching of the quarters, one of the pairs of eyelets 9 for laces being inserted through the reinforcing strips. Inside the shoe there is a cushioned arch support adhered to the under-vamp in the heel and arch region, the arch support being formed of an insole 10 of soft leather covering a pad of foamed plastics material 11.

Figures 1, 2, 9:
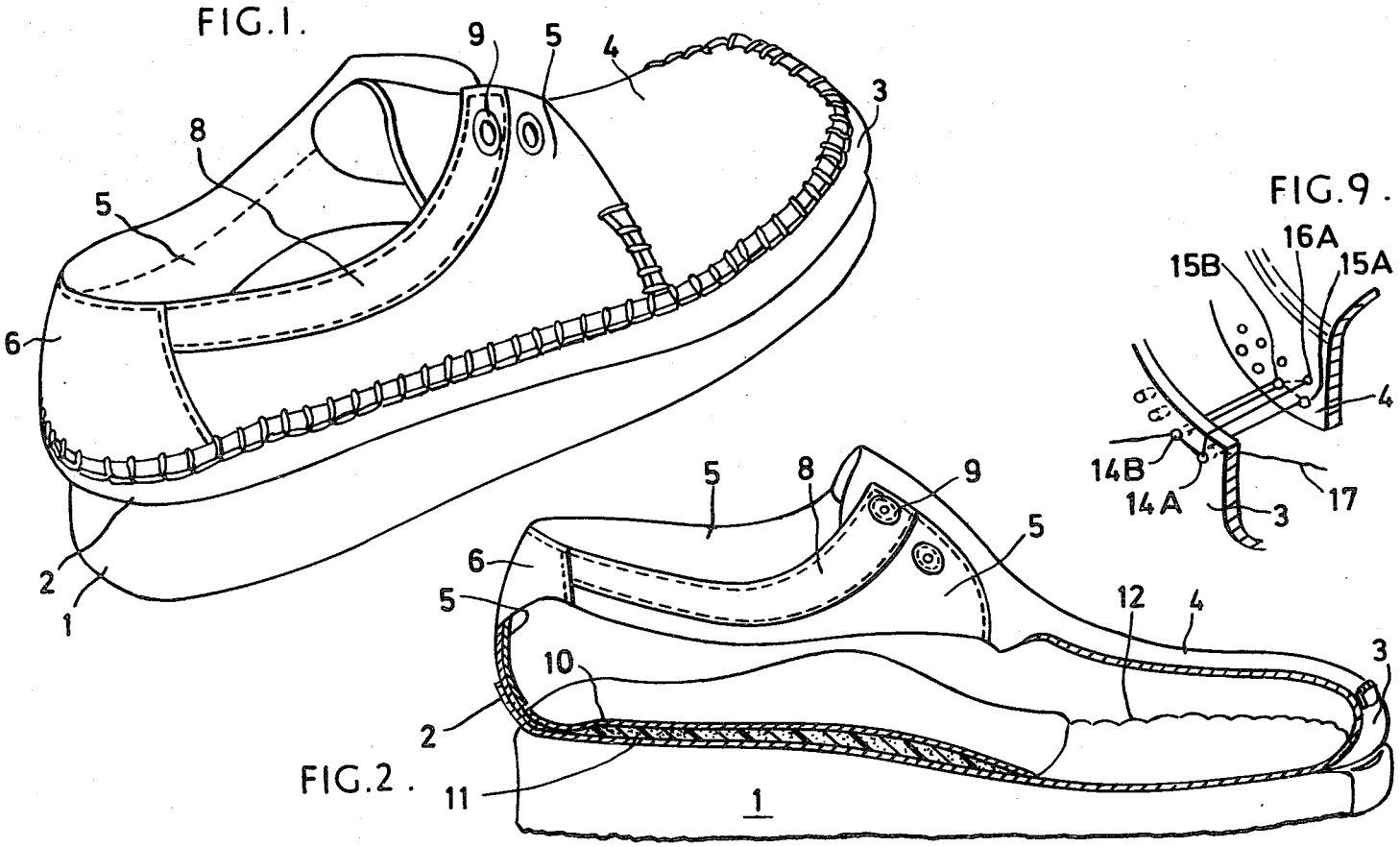
FIG. 1 is an elevation of a shoe in accordance with the invention.
FIG. 2 is an enlarged elevation, partly cut away, of a shoe in accordance with the invention.
FIG. 9 is an exploded fragmentary diagram showing the manner of hand stitching used in making the upper.

When the shoe is being made, the top line strips 8 are sewn into position (shown in dotted outline in FIGS. 5 & 6) on the quarters 5 and both quarters are sewn together at their rear edges 13 while they are also sewn to the counter 6. The upper vamp 4 and the assembly of quarters 5 plus counter 6 are then hand stitched to the under vamp 2. The under vamp 2 is provided with a series of holes 14 close to its edge. The edge region of the under vamp is turned up so that the holes extend around a continuous rim. The upper vamp 4, and quarters 5 are provided with two series of holes extending part of the way along the periphery of each piece, a major series of holes 15 close to the edge and a minor series of holes 16 adjacent to the major series on the side remote from the edge. Counter 6 also has a major series of holes 15 and a minor series of holes 16 but they are not close to the edge of the counter because it has a flap 18 which extends down inside the rim of the under vamp as a heel reinforcement. The edge region of the under vamp 2 overlaps the edge of each of the other pieces to such an extent that the holes 14 in the under vamp are aligned with the major series of holes 15 in the other pieces but the minor series of holes 16 is not fully overlapped. Hand stitching is carried out using a form of "blanket stitch" i.e. the main line of stitching passes in a line through the holes 14 of the under vamp and the major series of holes 15 of the other pieces but at each hole a loop stitch is carried over the top edge of the under vamp at right angles to the main line of stitching and through the adjacent hole of the minor series 16.

FIG. 9 shows a fragment of the rim 3 of the under vamp 2 and a fragment of the upper vamp 4. Yarn 17 is threaded forward through hole 14A, along in a line to hole 14B, back to hole 15B, along the back of the upper vamp to hole 15A, forward to hole 14A again, up over the top edge of the rim 3, back to hole 16A, then at an slant down the back of the upper vamp to hole 15B and forward to hole 14B again.

The completed upper forms a bag-like shape. The leather used is a soft leather of heavier grade than that conventionally used in commercial footwear. The closed upper is placed on a last of the nature-form type and the shape of the upper is set in a heat setter i.e. a heating chamber with a moist atmosphere at about 275° F. (135° C.). During heat setting the under vamp becomes moulded into a dished configuration with the continuous rim standing up all around the periphery of the shoe.

When the upper is on the last after heat setting, a coating of adhesive is applied to the exterior of the under-vamp. A mid-sole (a thin layer of crepe rubber) is adhered to the under-vamp, the upper is removed from the last, and the mid-sole is then machine-sewn to the under-vamp by stitches 12 close to the perimeter of the mid-sole. The upper is returned to the last, a wedge portion of crepe rubber is adhered to the mid-sole in the region of the heel and arch, and an outer sole portion of crepe rubber is then adhered to the wedge portion and mid-sole.

Instead of the blanket stitch described above it is also satisfactory to use a form of "box stitch" in which a second line of stitching is carried out through the holes 16 of the minor series. Loop stitches are included in the same manner as described above in order to hold the top edge of the rim of the under vamp tightly against the other pieces of the upper in their area of overlap.

It will be noted that the shoe according to the invention has no rigid insole under the heel and arch of the foot. Instead the foot is walking on soft leather and crepe rubber. This results in a shoe having a high degree of flexibility and resilient comfort, the resilience of the crepe rubber being used to full advantage. The work involved in attaching an insole to an upper on a last has been eliminated. The shoe does not have a vulnerable seam extending down to the outer sole at the back of the heel. On the contrary the shoe has a continuous rim extending up from the outer sole and a line of hand stitching at the top of the rim all around the shoe which presents a novel and attractive appearance.

We claim:

1. An article of footwear having an outer sole of resilient material, an under-vamp of soft leather extending over the whole area of the outer sole, the edge of the under-vamp being turned up to form a continuous unseamed rim around the article of footwear, and an upper vamp, a pair of quarters and a counter all of soft leather hand-stitched to the rim to form an upper.

2. An article of footwear according to claim 1 wherein the upper vamp, quarters and counter each overlap a portion of said continuous rim inside the top edge of said rim.

3. An article of footwear according to claim 2 wherein the overlapping portions are sewn together by a form of stitching which combines a continuous row of stitches parallel to the top edge of said rim and a series of loop stitches perpendicular to said top edge and looping over said top edge.

4. An article of footwear according to claim 3 wherein the upper vamp, quarters and counter are each provided with two adjacent series of holes through the leather and the rim of the under vamp is provided with one series of holes.

5. An article of footwear according to claim 4 wherein the holes in the rim of the under vamp are aligned with one series of holes in the upper vamp, quarters and counter while the top edge of said rim is level with the second series of holes in the upper vamp, quarters and counter.

6. An article of footwear according to claim 1 wherein the outer sole is crepe rubber.

* * * * *